US005498856A

United States Patent [19]

Carlsson

[11] Patent Number: 5,498,856

[45] Date of Patent: Mar. 12, 1996

[54] MICROWAVE OVEN FOR HEATING OF BEVERAGES

[75] Inventor: Hakan Carlsson, Norrkoping, Sweden

[73] Assignee: Whirlpool Europe B.V., Veldhoven, Netherlands

[21] Appl. No.: 261,499

[22] Filed: Jun. 17, 1994

[30] Foreign Application Priority Data

Jun. 18, 1993 [SE] Sweden ..... 9302128

[51] Int. Cl.[6] ..... H05B 6/80

[52] U.S. Cl. ..... 219/689; 219/756; 219/711; 219/739; 219/762

[58] Field of Search ..... 219/756, 746, 219/688, 705, 707, 710, 711, 689, 739, 762

[56] References Cited

U.S. PATENT DOCUMENTS

| | | | |
|---|---|---|---|
| 2,919,336 | 12/1959 | Hahn | 219/746 |
| 3,396,342 | 8/1968 | Feinberg | 328/262 |
| 4,379,964 | 4/1983 | Kawazawa et al. | 219/705 |
| 4,673,782 | 6/1987 | Koepke et al. | 219/697 |
| 4,762,973 | 8/1988 | Schultz | 219/756 |
| 5,057,660 | 10/1991 | Yamada et al. | 219/746 |
| 5,252,797 | 10/1993 | Komatsu | 219/756 |
| 5,315,084 | 5/1994 | Jensen | 219/689 |

FOREIGN PATENT DOCUMENTS

| | | |
|---|---|---|
| 8802528 | 7/1988 | Sweden . |
| 8802529 | 7/1988 | Sweden . |
| 8803663 | 10/1988 | Sweden . |
| 398831 | 9/1965 | WIPO . |
| 8301397 | 9/1983 | WIPO . |
| 8909011 | 3/1990 | WIPO . |
| 9210919 | 9/1993 | WIPO . |

*Primary Examiner*—Philip H. Leung
*Attorney, Agent, or Firm*—Robert O. Rice

[57] ABSTRACT

A method for the heating of beverages or foodstuffs in fluid form contained in a package or container which is placed in a microwave oven whose cavity is adapted as to the dimensions and shape of the package or container. When the target temperature of the beverage or foodstuff is reached, heating is ceased. A microwave oven for such heating includes a package-adapted cavity and control means for ceasing heating when the target temperature is reached, which can be sensed by incorporated means for sensing moisture release, IR radiation from the beverage or foodstuff or means for sensing its light permeability.

19 Claims, 1 Drawing Sheet

Fig. 1
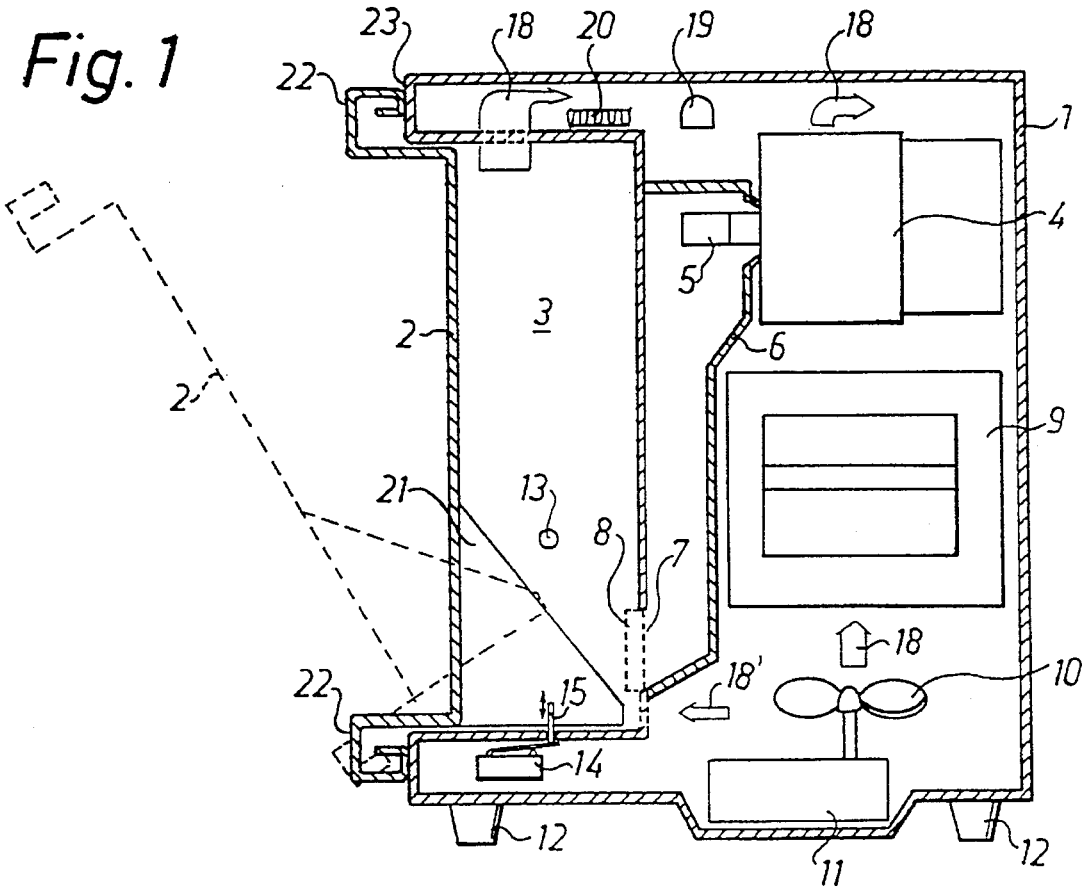
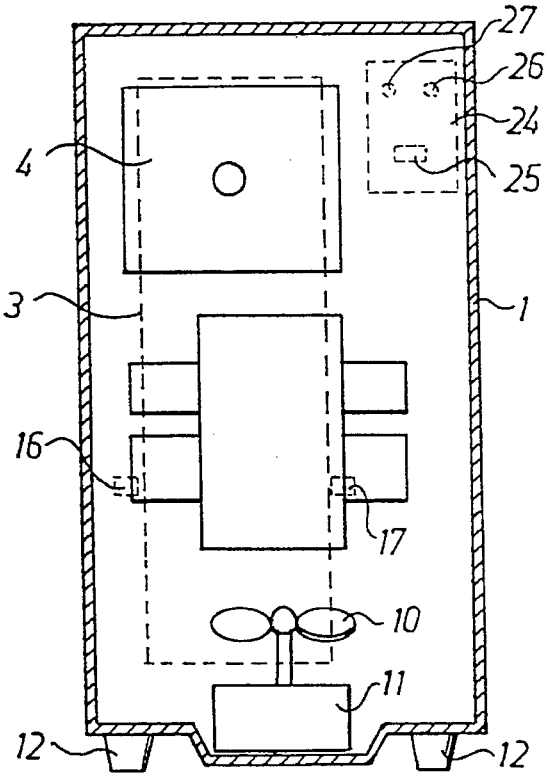
Fig. 2

MICROWAVE OVEN FOR HEATING OF BEVERAGES

BACKGROUND OF THE INVENTION

The present invention relates to a method for heating foodstuffs in fluid form including beverages to a target temperature, the beverage or foodstuff being contained in a package or container of defined exterior shape and manufactured from a microwave permeable material. As it is used herein, the term "target temperature" has the meaning of a "ready-to-use" temperature when referring to precooked or ready-made foodstuffs or a "finished preparing" temperature when preparing fresh foodstuffs for consumption or for use in further preparation steps.

The invention also relates to a microwave oven for performing the method and to the use of a microwave oven having an oven cavity whose dimensions and shape are adapted to a package or container for the heating of a beverage or foodstuff in fluid form contained in that package or container.

The problem which the invention is designed to alleviate is to provide rapid, economical and effective heating of beverages or food items and foodstuffs in fluid form contained in a package or container to a predetermined temperature. The package or container is manufactured, for example, from paper, plastic or combinations thereof or from other material.

SUMMARY OF THE INVENTION

A desirable objective is to enable heating of fluids in their package or container and to provide a hygienic treatment which ensures maintained quality in the beverage or foodstuff.

The drink or foodstuff can, for example, consist of coffee and the packaging can then consist of two parts, one being an inner package, usually of plastic, which contains coffee powder, the other being an outer package containing water. When the water reaches the beverage-preparing temperature, the inner package is opened and the coffee powder and water mixed within the outer package, which can then be used as a serving vessel. Other examples of beverages or foodstuffs where this type of packaging can find utility are various sorts of soups and hot fruit drinks, e.g. blueberry and rosehip soup, and baby food. These beverages and foodstuffs have in common that they require heating to a defined temperature, the "preparing" temperature, which should not be substantially exceeded if the right quality is to be attained. This defined, i.e. "target " temperature can be a preparing temperature, which in the case of coffee can be 91°–92° C., or a consuming temperature of around 65° C. as in the case of blueberry or rosehip soup.

Using microwaves for the heating procedure should enable the posed hygienic and handling-related requirements to be met and similarly the possibility of heating the beverage or foodstuff in its packaging. However, the household-use microwave ovens currently on the market are designed for many different heating and food preparation rôles. This means that the oven cavities are comparatively large in order to provide room for various sorts of vessels, plates etc. At one point, heating can consist of thawing a foodstuff using a particular thaw program, in a second instance, heating of water to boiling temperature and at a third point, warming up a ready-cooked foodstuff. This requires advanced control of the microwave oven and the capability to set up many different preparation programs. A spacious oven cavity necessarily implies that the microwave oven has correspondingly large exterior dimensions. Adjusting such an oven to many different heating and preparation situations also implies that the oven is not optimized for certain types of heating, such as those described above. This therefore causes prolonged heating time and possibly decreased heating quality through uneven heating.

One object of the invention is to provide a microwave heating method which is optimized to just those beverages or foodstuffs then being handled.

The object of the invention is attained in a method of the type defined in the introduction that the package is placed in a microwave oven having a microwave cavity which is adapted in shape and dimensions to the package or container, the cavity being substantially completely filled in two dimensions by the package or container and substantially completely or partially in its third dimension, the microwave energy is supplied to a lower portion of the package via an input aperture in the lower portion of the package-adapted cavity, and the microwave input is ceased when the target temperature is reached.

This method means that the volumetric efficiency of the oven cavity is very high and leads to effective, rapid and substantially loss-free heating with the lowest possible energy expenditure. As the microwave energy is supplied to a lower portion of the package, natural convection is set up in the beverage or the foodstuff in fluid form which thus ensures even heating of the entire fluid volume. Using an oven cavity which is adapted to the package or container, which in the above case of coffee can have a volume of 1 liter and be of the milk or juice carton type or possibly half this volume, means that the microwave oven as a whole can be given smaller external dimensions which makes the oven easily locatable as it requires no greater space than an ordinary coffee brewer. When using a "half carton " with the same bottom area as an ordinary carton but approximately half the height, correspondingly effective heating is obtained as the microwave energy is supplied to the lower portion of the package.

In accordance with a preferred embodiment of the method of the invention, a target temperature-indicating parameter of the beverage or foodstuff is sensed externally of the package or container.

In accordance with a further preferred embodiment of the method of the invention, the temperature is sensed by picking up IR radiation from the beverage or foodstuff via an IR permeable area of the package wall using an IR sensor. According to a further embodiment, the temperature is established by sensing the moisture release from the beverage or foodstuff using a moisture sensor. Moisture release from the package is effected via a vent or other aperture which is opened prior to introduction of the package to the cavity.

An additional embodiment involves establishing reaching of the target temperature by sensing changes in the light permeability of the beverage or foodstuff using an optical sensor.

Handling of the package or container while it is being introduced to, or removed from, the oven cavity is facilitated in a preferred embodiment of the method of the invention wherein the package or container is introduced to the cavity using the oven door of the microwave oven, the package or container being placed in a holder disposed on the door and introduced to/removed from the cavity by the closing/opening movement of the door.

A microwave oven in accordance with the invention for the heating of beverages or foodstuffs in fluid form to a target temperature, the beverage or foodstuff being packed in a package or container having a predetermined shape and which is manufactured from a microwave permeable material, comprises an oven cavity in which the package or container is placed during heating, an oven door for closing the cavity during the heating procedure, and a microwave source with associated input means for inputting microwaves to the cavity through at least one input aperture and wherein the oven cavity is adapted as to shape and dimensions to the package or container so that the package or container substantially fills the cavity in two or three dimensions, the inlet aperture is disposed in a lower portion of the cavity adjacent or adjoining the bottom of the cavity, and control means are arranged to cease the heating procedure when a target temperature is reached.

A preferred embodiment of the microwave oven of the invention is comprises sensing means provided for sensing the temperature of the beverage or fluid during the heating procedure. This temperature sensing means can comprise a moisture sensor which is arranged to sense moisture in an airstream through the cavity, or alternatively an IR sensor which is arranged to sense IR radiation from the beverage or foodstuff via an IR permeable area of the package wall, or alternatively an optical sensor comprising a light emitting diode and a phototransistor disposed opposite each other on either side of the cavity, the light from the light emitting diode passing through the beverage or fluid via light permeable windows in the package walls to the phototransistor.

Controlling the microwave oven by sensing target temperatures enables significant simplification of the oven control system and the oven operating panel and thereby simplified management of the oven. These simplifications in combination with the fact that the package-adapted cavity provides small exterior dimensions for the oven mean significant cost savings during manufacture of the oven. The small exterior dimensions of the oven make it easily locatable in its environment of application and thereby enhance its opportunities for widespread use.

A preferred embodiment of the microwave oven of the invention comprises an oven door provided with a holder for the package or container which is introduced to/removed from the cavity by closing/opening of the door. In this fashion, a well defined movement path for the package is achieved and precise conforming of the dimensions of the cavity to the package is enabled, as is good package accessibility. At the same time, handling of the package is facilitated, especially when heated.

The invention also relates to the use of a microwave oven having an oven cavity whose dimensions and shape are adapted to the dimensions and shape of a package or container of microwave permeable material for the heating of a beverage or foodstuff in fluid form contained in the package or container while using the package or container as a heating vessel.

Additional features of the invention are evident from the accompanying patent claims.

BRIEF DESCRIPTION OF THE DRAWING

The invention will now be described in greater detail in connection with a preferred embodiment and with reference to the accompanying drawings, in which:

FIG. 1 depicts a partially sectional side view of the microwave oven of the invention; and FIG. 2 depicts a partially sectional frontal view of the oven of FIG. 1.

DETAILED DESCRIPTION OF THE INVENTION

The microwave oven depicted in FIG. 1 comprises a casing 1 having an oven cavity 3 which is closed off by an oven door 2. The door 2 is depicted schematically by its component metal construction which consists of metal sheeting enclosing a cavity and whose edges terminate with a microwave sealing choke 22 which runs around the oven door. In the closed position, the door abuts a planar flange 23 running around the cavity. Something noteworthy about the oven door is that it lacks a window.

The oven door is hingedly suspended at its lower edge and has a restricted degree of opening, which is preferably <45°. Restriction of the degree of opening is provided by catch means (not depicted) of the type known in the art. The orientation of the oven door in the open position is indicated by a ghost depiction of the door using broken lines. Reference is made to Swedish patent no. 8301397-9 for greater detail as to the mechanical set up of the door.

The lower region of the inside of the door is provided with a holder 21 having substantially the same depth and breadth as the cavity. At the same time, the holder also conforms to the lower portion of the relevant package or container, which is placed in the holder when the door is in the open position, introduced into the cavity by closing the door and removed from the cavity by opening the door. In this way, handling of the package is facilitated and a good fit is enabled especially between the side walls of the cavity and the package as additional space to allow gripping of the package is not needed. The package does not need to be equipped with special grip means, either.

A cooling fan 10 is located lowermost in the case with an associated drive motor 11, a transformer 9 and a microwave source in the form of a magnetron 4 with associated antenna 5 which projects into a wave guide 6 in communication with an inlet aperture 7 into the cavity 3.

The cooling fan 10 produces an air stream 18 of which a part 18' passes into the cavity through a perforation in its back wall and leaves the cavity through a corresponding perforation in its roof into an exhaust air duct which discharges to the rear of the oven. The rest of the air stream is directed upwardly to cool the transformer 9 and the magnetron 4. The air stream is indicated with arrows 18.

A moisture sensor 19 is located in the exhaust air duct 18 and senses the amount of moisture released by the package or container and which is conveyed by the air stream through the cavity. The "target " temperature of the beverage or foodstuff corresponds to a defined moisture content in the exhaust from the cavity sensed by the moisture sensor which in turn provides a signal to the control electronics of the oven which ensures that the microwave input is ceased.

An alternative possibility to sense the target temperature involves using an optical sensor consisting of a light source in the form of a light emitting diode 16 and a light receiving means in the form of a phototransistor 17 (see FIG. 2). The light emitting diode 16 and the phototransistor 17 are disposed opposite each other outside the respective side walls of the cavity. The light from the light emitting diode 16 passes through a hole 13 in the wall of the cavity, through the package and out through a corresponding hole in the opposite side wall to the phototransistor 17. This type of sensor is particularly well suited to applications where a discontinuous change in the light permeability of the beverage or foodstuff corresponds with the target temperature. An example of such an application comprises the preparation of coffee as described above. When the interior container with coffee powder enclosed is opened at the ready temperature, the coffee powder mixes with the water and gives a discontinuous change in the light permeability. This sensing technique presupposes that the package or container is manufactured from a light permeable material or includes areas of such a material at the level of the holes 13.

The ready temperature can also be established via an IR sensor which senses the heat radiation from the package. Such an IR sensor can be arranged in a corresponding fashion to the light emitting diode 16 or phototransistor 17, i.e. outside the cavity adjacent a hole 13.

A "door switch " 14 is located in the space underlying the floor of the cavity and consists of a microswitch whose operating arm is acted on by a vertically oriented operating pin 15 having a spring bias return. The operating pin 15 runs through a hole in the bottom of the cavity and a corresponding hole in the bottom of the holder. The operating pin is so shaped and arranged that it is inaccessable to manipulation when the oven door is open. The operating pin is constructed so that it is actuated by the package or container in the holder 21 when the door is closed. In this event, the operating pin 15 is pressed downwardly and the switch 14 closes a safety circuit which enables activation of the microwave source 4. If there is no package in the holder 21, no closing of said safety circuit is effected and activation of the magnetron 4 is prevented in the absence of a load in the cavity. The construction of the switch 14 provides dual functions, i.e. it is both door and load sensing. The operating pin or corresponding means can alternatively be arranged in the side wall of the cavity or the rear wall for cooperating with the holder and package or container upon closing/opening of the door.

In accordance with the current requirements, there are also additional safety switches which are controlled by the oven door. Accordingly, an additional switch is located adjacent the bottom of the cavity and has an operating means acted on by the underside of the holder 21 regardless of whether the holder contains a package or not. Additionally, a still further switch is located in the space overlying the roof of the cavity and has return biased operating means acted on by the inner side of the door.

The incorporated fan device 10 with associated drive motor 11 and the transformer 9 are set up in conventional fashion and similarly the microwave source 4 with its magnetron is of a standard type. These components are of no significance to the invention and reference is made to U.S. Pat. No. 3,396,342 and Swedish patent nos. 8802528-3, 8802529-1 & 8803663-7 for further details of their construction.

One broad side of the wave guide 6 is formed by the rear wall of the cavity. The wave guide is of the "TE10" type. Depending on the microwave properties of the actual load, its permittivity etc, a more or less large impedence step results in the transition between the wave guide 6 and the cavity 3. This impedence step complicates energy transfer from the wave guide to the load.

Matching of the impedence between the load and microwave input system is provided by an impedence transforming means in the form of a ceramic plate 8. The thickness of the ceramic plate should approximate a quarter of the microwave wavelength in the ceramic material. Using a standard magnetron with a frequency of 2.45 GHz implies a plate thickness of around 11 mm in the case of an oven for heating, for instance, coffee, bearing in mind desirable relationships between the dielectric constants for the ceramic plate and water. The well defined position of the package or container in the cavity, with the assistance of the door, ensures abutment between the package and ceramic plate.

The cavity can be externally coated with a layer of heat insulating material, as is indicated in enlarged scale at 20, in order to facilitate heat retention in the beverage or foodstuff following cessation of heating. In the event that the oven is provided with a special heating container having the shape of the cavity, the holder is conveniently manufactured of a transparent and heat insulating material.

In FIG. 2, the position of the cavity is indicated with broken lines. As is depicted in this Figure, the cavity is displaced somewhat to the left in the oven casing 1. The aim of this is to provide room in the right side of the casing for the oven control electronics, which are mounted on a printed circuit board, and its cooperating control panel mounted on the right side of the front of the oven. When the oven is solely intended for heating beverages and foodstuffs to specific temperatures, the control electronics are relatively simple and conventional. Conveniently, a pre-set maximum duration timer is included which invariably ceases the microwave supply to the cavity when the maximum duration is reached and thereby prevents damage to the oven in the event of malfunction.

The oven control panel 24 is indicated with broken lines in FIG. 2. When no settings need to be altered, the control panel can be of a simple type. At its simplest, the control panel can comprise a start button 25, a "Heating " indicator lamp 26, and a "Ready " indicator lamp. The "Heating " lamp is illuminated during the heating procedure. The "Ready " lamp lights up when heating is ceased. Following the cessation of heating, a heat retention period commences. If the package or container and its contents are still in the oven at the end of the heat retention period, the "Ready " indicator lamp changes from a steady to a blinking signal. The blinking signal indicates that the "forgotten " beverage or foodstuff no longer retains its quality.

In the event that the oven is intended for heating a number of different beverages and foodstuffs in fluid form, the oven control panel is provided with a start button for each of such beverages or foodstuffs.

It is also possible in the practice of the invention to utilize a timer function to cease the microwave supply at the ready temperature, the timer being set in motion at the start by the oven and the microwave supply being ceased by the same after a pre-set time.

I claim:

1. A method of the heating of foodstuffs in fluid form to a target temperature, the foodstuff being contained in a container of defined exterior shape and which is manufactured from a microwave permeable material, comprising the steps of placing the container in a microwave oven door, moving the door to a closed position to form an oven cavity with the container therein, shape and dimension corresponding to the defined exterior shape of the container, the cavity being substantially completely filled in two dimensions by the container and substantially or completely filled in its third dimension, supplying microwave energy to a lower portion of the container by inputting microwaves via an input aperture in the lower portion of the package-adapted cavity, and the ceasing said microwave energy when the target temperature is reached.

2. A method according to claim 1, wherein a target temperature-indicating parameter of the foodstuff is sensed externally of the container.

3. A method according to claim 2, wherein the target temperature is sensed by picking up IR radiation from the foodstuff using an IR sensor.

4. A method according to claim 2, wherein the target temperature is sensed by sensing the moisture emitted by the foodstuff using a moisture sensor.

5. A method according to claim 2, wherein the target temperature is sensed by sensing the light permeability of the foodstuff using an optical sensor.

6. A method according to claim 1 wherein the container is introduced to, and removed from, the cavity using the oven door of the microwave oven, the container being placed in a holder disposed on the door and introduced to, or alternatively removed from, the cavity by closing and opening movements, respectively, of the door.

7. A method according to claim 1 wherein the foodstuff is first transferred to a special heating container which is adapted in shape and dimension to the cavity and the container is thereafter introduced to the cavity.

8. A microwave oven for the heating of foodstuffs in fluid form to a target temperature, the foodstuff being contained in a container with a predetermined shape and manufactured from a microwave permeable material, comprising a cavity in which the container is placed during heating, an oven door having means for receiving said container in an open position and means for closing the cavity during the heating procedure and a microwave source with associated input means for inputting microwaves into the cavity through at least one input aperture wherein the oven cavity has the same shape and dimension as the container so that the container substantially fills the cavity in two or three dimensions, the input aperture is located in a lower portion of the cavity adjacent or adjoining the cavity bottom, and control means are arranged to cease the heating procedure when the target temperature is reached.

9. A microwave oven according to claim 8, wherein the inside of the oven door is provided with a trough shaped holder forming said means for receiving said container.

10. A microwave oven according to claim 8 wherein sensing means are arranged to sense a target temperature-indicating parameter of the foodstuff during the heating procedure.

11. A microwave oven according to claim 10, comprising an optical sensor for sensing the target temperature by sensing the light permeability of the foodstuff, the optical sensor comprising a light source and light receiving means cooperating therewith disposed opposite each other on either side of the cavity, whereby a beam of light can pass from the light source through a hole in one of the cavity side walls, through the container and through a corresponding hole in the opposite side wall, to the light receiving means.

12. A microwave oven according to claim 10, comprising a moisture sensor for sensing said target temperature, the moisture sensor being placed in an exhaust air duct for an airstream through the cavity.

13. A microwave oven according to claim 10, comprising an IR sensor for sensing said target temperature, the IR sensor being arranged to pick up IR radiation from the container via a hole in the cavity wall.

14. A microwave oven according to claim 8 wherein said input means for inputting microwaves into the cavity comprises a wave guide of the TE10 type, one end of which communicates with the microwave source and the other end of which discharges into said inlet aperture, and that an impedance transforming means in the form of a ceramic place is disposed in, and substantially coplanar with, said inlet aperture, whereby the ceramic plate substantially abuts the container during the heating procedure.

15. A microwave oven according to claim 8 wherein the outside of the cavity is provided with a heat insulating layer for maintaining the warmth of the foodstuff after cessation of the heating procedure.

16. A microwave oven according to claim 8 wherein the microwave oven control panel comprises a start switch for each type of foodstuff which is intended to be heated in the oven.

17. A microwave oven according to claim 8 wherein the oven comprises a pre-set maximum duration timer which is arranged to cease the microwave supply when the maximum duration is reached.

18. A microwave oven according to claim 8 wherein the oven comprises a load and door sensing switch, the switch being operated by a return biased operating means which is caused to assume a pressed back position by the pressure of the container disposed in said means for receiving said container upon closing of the door and returns to its initial position upon opening of the door.

19. A microwave oven comprising a door moveable between open and closed positions to form an oven cavity in said closed position, said door having means receiving a container in said open position, said oven cavity formed by closure of said door having dimensions and shape corresponding to the dimensions and shape of said container, said container composed of microwave permeable material for the heating of a foodstuff in fluid form contained in the container, the container providing a heating vessel for said foodstuff.

* * * * *